US008029424B2

(12) United States Patent
Thulin

(10) Patent No.: US 8,029,424 B2
(45) Date of Patent: Oct. 4, 2011

(54) TRAINING MACHINE FOR STRENGTH TRAINING AND REHABILITATION

(76) Inventor: Mats Thulin, Lidingo (SE)

( * ) Notice: Subject to any disclaimer, the term of this patent is extended or adjusted under 35 U.S.C. 154(b) by 0 days.

(21) Appl. No.: 12/398,478

(22) Filed: Mar. 5, 2009

(65) Prior Publication Data

US 2010/0227746 A1 Sep. 9, 2010

(51) Int. Cl.
*A63B 21/06* (2006.01)
*A63B 21/08* (2006.01)

(52) U.S. Cl. ..... 482/97; 482/137

(58) Field of Classification Search ..... 482/92–94, 482/97–103, 137, 138
See application file for complete search history.

(56) References Cited

U.S. PATENT DOCUMENTS

| | | | | |
|---|---|---|---|---|
| 2,356,260 | A * | 8/1944 | Maxwell | 482/129 |
| 2,921,791 | A * | 1/1960 | Berne | 482/118 |
| 4,406,452 | A * | 9/1983 | Lapcevic | 482/97 |
| 4,609,189 | A | 9/1986 | Brasher | |
| 4,657,246 | A * | 4/1987 | Salyer | 482/94 |
| 5,044,628 | A * | 9/1991 | Bracci et al. | 482/79 |
| 5,813,951 | A * | 9/1998 | Einsig | 482/97 |
| 6,482,135 | B1 * | 11/2002 | Ish et al. | 482/97 |
| 7,608,020 | B2 * | 10/2009 | Mason | 482/97 |
| 2006/0105889 | A1 * | 5/2006 | Webb | 482/94 |
| 2007/0149367 | A1 * | 6/2007 | Thulin | 482/100 |
| 2008/0076643 | A1 * | 3/2008 | Sencil | 482/97 |
| 2011/0105284 | A1 * | 5/2011 | Thulin | 482/98 |

FOREIGN PATENT DOCUMENTS

| | | | |
|---|---|---|---|
| DE | 4241639 | A1 | 6/1994 |
| EP | 732128 | A2 * | 9/1996 |
| FR | 2859384 | A1 | 3/2005 |
| WO | 2006041821 | | 4/2006 |
| WO | 2007037755 | | 4/2007 |

OTHER PUBLICATIONS

Extended European Search Report, dated Mar. 4, 2011, in EP 10 15 4630.

* cited by examiner

*Primary Examiner* — Loan Thanh
*Assistant Examiner* — Victor K Hwang
(74) *Attorney, Agent, or Firm* — Young & Thompson

(57) ABSTRACT

A training machine for strength training and rehabilitation includes: a machine frame, a weight carrying frame, a weight package carried by the weight carrying frame, pull or press elements which are turnably provided on the machine frame and which are arranged to be moved backwards and forwards while a selected pre-determined number of weights in the weight package is arranged to be turned about a first axis, alternatively, by connection elements connected to the pull or press elements, and drive members to lift weights by a first force and to lower the weights by a second force, the first force being less than the second force, the weight carrying frame being turnable on the machine frame about a substantially horizontal second axis and the first and second axes being substantially perpendicular to each other.

7 Claims, 11 Drawing Sheets

TRAINING MACHINE FOR STRENGTH TRAINING AND REHABILITATION

TECHNICAL FIELD

The present invention is related to a training machine for strengthen training and rehabilitation of the kind which is defined in the pre-characterising portion of claim 1.

BACKGROUND OF THE INVENTION

Such a training machine is previously known by WO 2006/041821. This machine has innumerable parts and is therefore very complicated to as well its construction as its function.

At many already known training machines for anaerobic training the user exercises intended muscles of the body by performing pre-determined movements so that a weight package of a weight stack is lifted or lowered. At efficient training with single-joint movements, as by means of a biceps curl machine or a leg extension machine, as well as with multiple-joint movements, as by means of a rowing machine, a bench press machine or a leg press machine, it is important that the user of the machine can perform a number of positive and negative working cycles intended for the personal capacity of the training person. The positive work means that weights are being lifted and the negative work means that weights are being lowered.

When a person lowers and lifts the same number of weights of a weight package, no consideration is taken to the fact that the negative, i.e., lowering, force of the person is greater than the positive, i.e., lifting, force of the person. Therefore, the effect of the training machine is limited. At training with conventional training machines the number of weights must be selected with regard to the weaker, lifting strength of the training person. The same number of weights is thereafter lowered at the negative part of the movement. Hence, this number of weights is not on a level with the negative strength.

A training machine which takes into consideration the different forces of the training person is known from WO 2007/037755 in which the load is decreased when initiating the positive movement and is increased automatically to its original value at the top of the positive movement just when the user starts the negative movement. Another similar training machine is disclosed in U.S. Pat. No. 4,609,189 in which the user can chose when the weights are to be tilted. However, at these machines the whole weight rack is tilted which means that the machine must use much space when performing this movement.

OBJECT OF THE INVENTION

The object of the present invention is to provide a training machine of the type mentioned above which sets aside the above mentioned problems.

The object is achieved by means of a training machine having the characteristics defined in claim 1.

Preferred embodiments of the invention have been given the characteristics which are apparent in the sub claims.

BRIEF SUMMARY OF THE INVENTION

By means of the training machine according to the invention a compact training machine can be achieved which is simple to its construction, yet attaining the advantages at the prior art training machines.

BRIEF DESCRIPTION OF THE DRAWINGS

The invention is described in the following with reference to the appended drawings showing preferred embodiments.

DESCRIPTION OF PREFERRED EMBODIMENTS OF THE INVENTION

Figure 1:
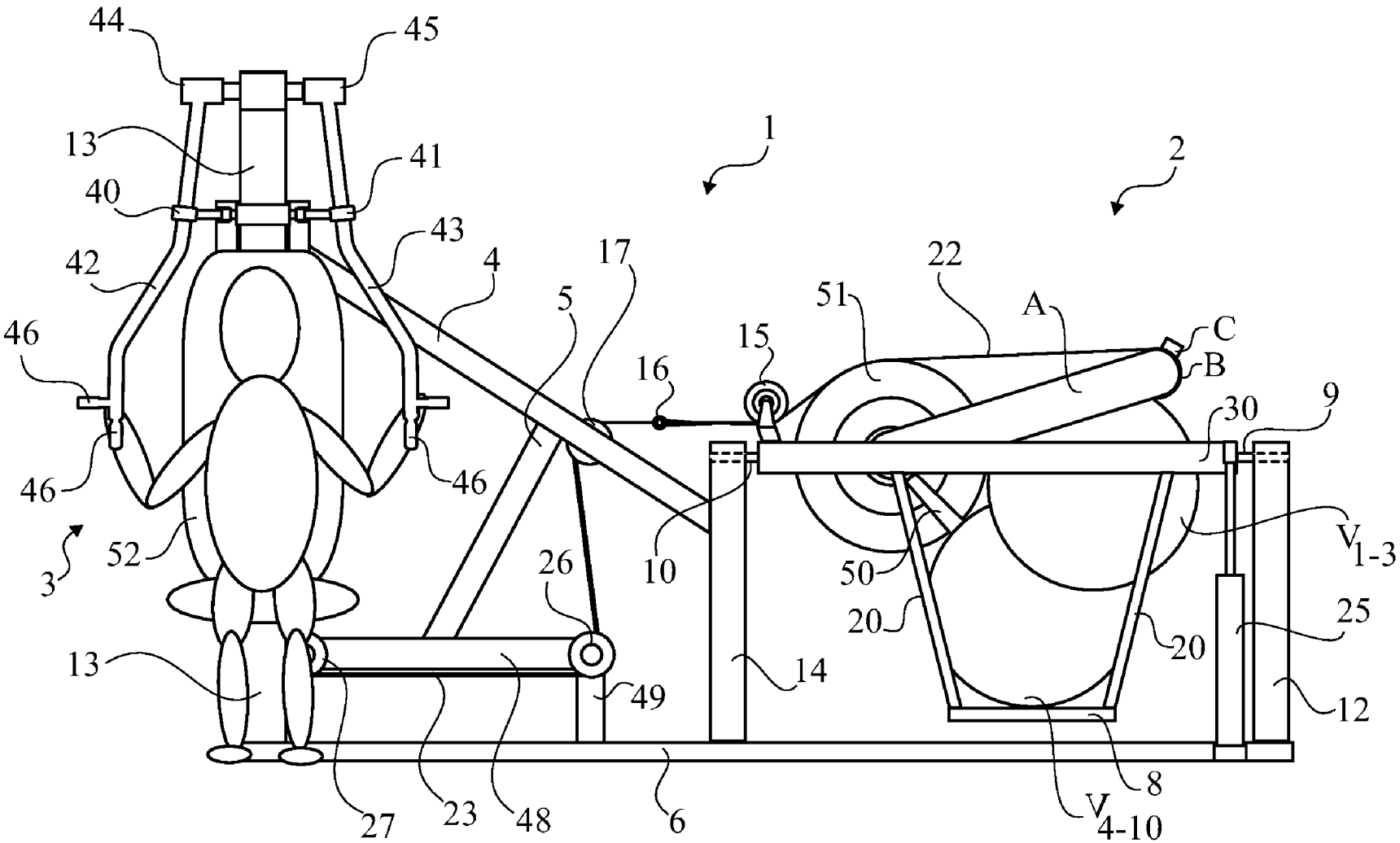
FIG. 1 shows a front view of a first embodiment of a training machine for strength training and rehabilitation according to the invention.

Similar details in the different embodiments are denoted with the same reference numerals.

In FIG. 1-7 an embodiment of a training machine 1 for strength training and rehabilitation according to the invention is shown, which machine comprises a weight section 2 and a training section 3 which are mounted within a frame comprising inclined beams 4 and 5 as well as beams 6 which form a substantially rectangular base and are arranged in a substantially horizontal plane and fixed connected at the lower part of said sections 2 and 3. The weight section 2 has an inner substantially rectangular frame portion 30 (see FIGS. 1 and 7) which is turnably journalled in pivots 9 and 10 between outer inclined beams 11, 12 and 13, 14, respectively. The inclined beams 11, 12 and 13, 14 form equilateral triangles with the base 6. A shaft 7 is mounted between opposite beams 30' and 30" of the frame portion 30. A rest plate 8 is fixed to four supporting beams 20 at the frame 30. Circular weights $V_{1-10}$ which in the rest position abut against the rest plate 8 are fixed on arms 50 which each are provided with a ring 52 at the end opposite to the weights $V_{1-10}$. The rings 52 are turnably journalled on the shaft 7. A rotatable wheel 51 is mounted on the shaft 7 between the weights $V_5$ and $V_6$, i.e., substantially at the middle of the shaft 7. A U-formed lifting member A/B is turnably journalled at the outer ends of arms A at the shaft 7 and is provided with through holes 53 on the bracket B of the U-formed member A/B. The holes 53 are so arranged that they in the rest position of the weights $V_{1-10}$ on the rest plate 8 will be situated flush with corresponding holes 54 in the rims of the weights (see FIG. 5). A stop shaft 21 is fixed to the outermost weight $V_1$. Each weight $V_{1-9}$ is provided with an open recess 70 which is arranged to receive a protrusion 60 fixed on the opposite side of the weights $V_{2-10}$ to catch next weight in the selected weight package, when it is lifted up by a person exercising in the machine. In this embodiment weight $V_3$ is selected which means that when weight $V_3$ is lifted it catches weight $V_2$ which in turn catches $V_1$ and results in that all three weights $V_{1-3}$ are lifted simultaneously.

A non-elastic wire or belt 22, preferably made by the material Kevlar®, is fixed at a central point on the bracket B of the U-formed member A/B. The belt 22 is lead over the wheel 51 and a small control wheel 15 journally fixed at the frame 30 to a connection member 16 where it is connected to a further non-elastic wire or belt 23, likewise preferably made by the material Kevlar®. This belt 23 is further connected to the movable parts of the training section 3 of the machine.

A horizontal beam 48 is via vertical beams 49 fixed connected to the beam 6 of the lower frame portion and the frame construction of the training section. The lower ends of the inclined beams 5 are fixed between the beam 48 and the inclined beams 4 which in turn are fixed to the beams 13 and 14 of the weight section. The beams of the frame construction of the training machine 1 are advantageously welded to each other to achieve a solid construction, which shall be able to stand high loads concerning pull and press loads as well as vibrations.

Before lifting and lowering of weights, a weight package (in this case $V_{1-3}$) is selected by means of a pin member C. If, e.g., $V_{1-3}$ is intended to be lifted, as shown in the drawings, the person sticks the pin member C through holes 53 and 54 in the bracket B and the weight $V_3$. The lifting movement of the selected weight $V_3$ results in that the protrusions 60 of the weights $V_3$ and $V_2$ in the recesses 70 in the weights, $V_2$ and $V_1$, respectively, lifts the weights $V_2$ and $V_1$ as well and all three weights $V_{1-3}$ are then accordingly lifted up simultaneously when the belt 22 is pulled by the person pressing the handles 46 at the training section 3. After the pulley 15 the belt extends around a further pulley 17 (see FIG. 1) and around another pulley 26 mounted on beams 48, 49. From the pulley 26 the path of the belt 23 extends substantially horizontal towards a further pulley 27 mounted on the beam 48 and runs thereafter upwards through a pulley 28 of an equalisation device 29 to an attachment 23*a* which is provided on a protrusion on the beam 49*a*. The equalization device 29 comprises besides the pulley 28 a further pulley 31, which as the pulley 28 is journalled in freely hanging linkage arms 32 and 33. A further non-elastic wire or belt 34, preferably made by the material Kevlar®, is mounted at its end by means of fastening devices 35 to the lower ends of arcuately extending turning arms 36 and 37, respectively. The equalisation device with the further belt 34 has been mounted in a well known way to equalize the power from the arms of the training person at loading towards the arms 42 and 43 which accordingly do not need to be moved away from the person the same distance to achieve effect because a person in most cases is not equal strong in both right and left arm.

At the opposite upper ends of the arms 36 and 37 linkage arms 38 and 39 are mounted, which are moveable in all directions, e.g., by means of a ball-and-socket joint. The arms 38 and 39 are in turn at their other ends in all directions freely moveably connected to couplings 40 and 41 mounted on pull and press arms 42 and 43, which in turn are freely turnably journalled at their upper ends on the frame construction 55 at 44 and 45, respectively. The handles 46 are provided at the lower ends of the arms 42 and 43. The turning arms 36 are journalled on a common through shaft 47 fastened at the frame construction 55. The turning arms 36 are freely journalled independently of each other on the shaft 47. A stop 47*a* restrains the movements of the turning arms in one direction of rotation.

A hydraulic cylinder device 25 is pivotally mounted between the lower frame 6 and the tiltable frame 30. By activating the cylinder device 25, the inner frame 30 of the weight section 2 is arranged to rotate about the pivot pins 9 and 10, as is best evident from FIGS. 15 and 16. The hydraulic cylinder device 25 is shown as an example of a device to turn the inner frame 30 in relation to the outer frame consisting of beams 6 and 11-16. Other known devices to perform this work can of course be used within the frame of the appended claims, as, e.g., a linear electro motor etc.

Figure 3:
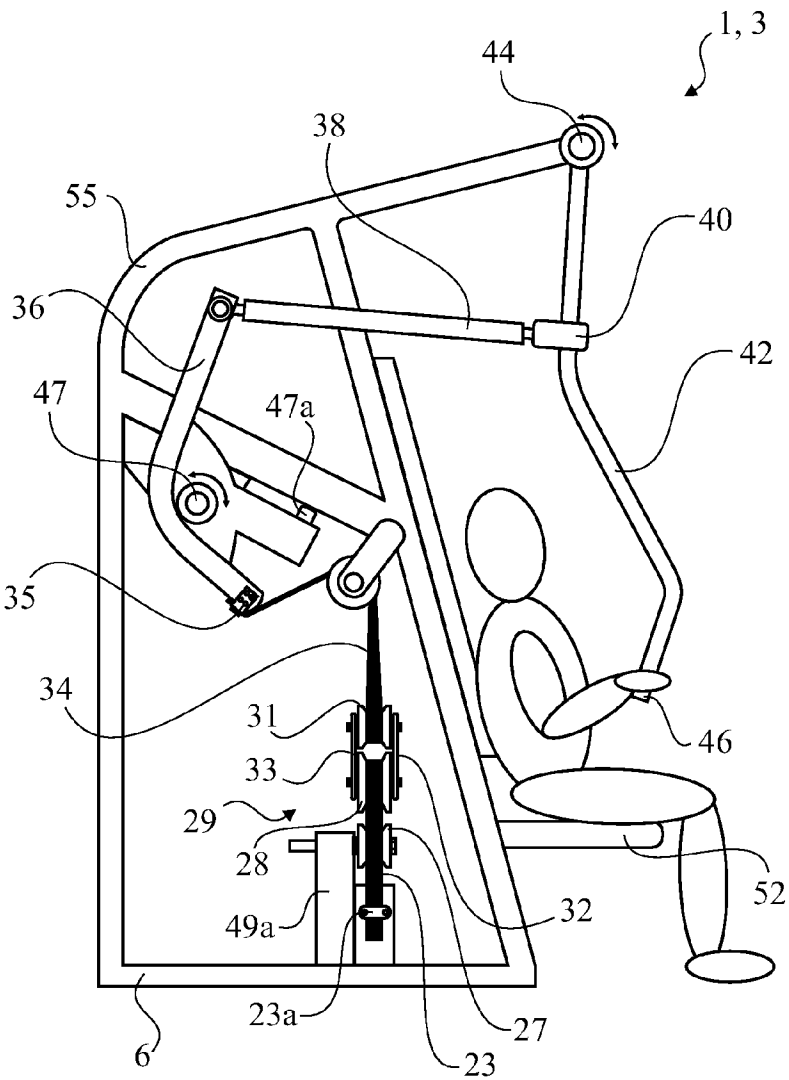
FIG. 3 shows a side view of the training machine of FIG. 1 in an initiating position.
Figure 2:
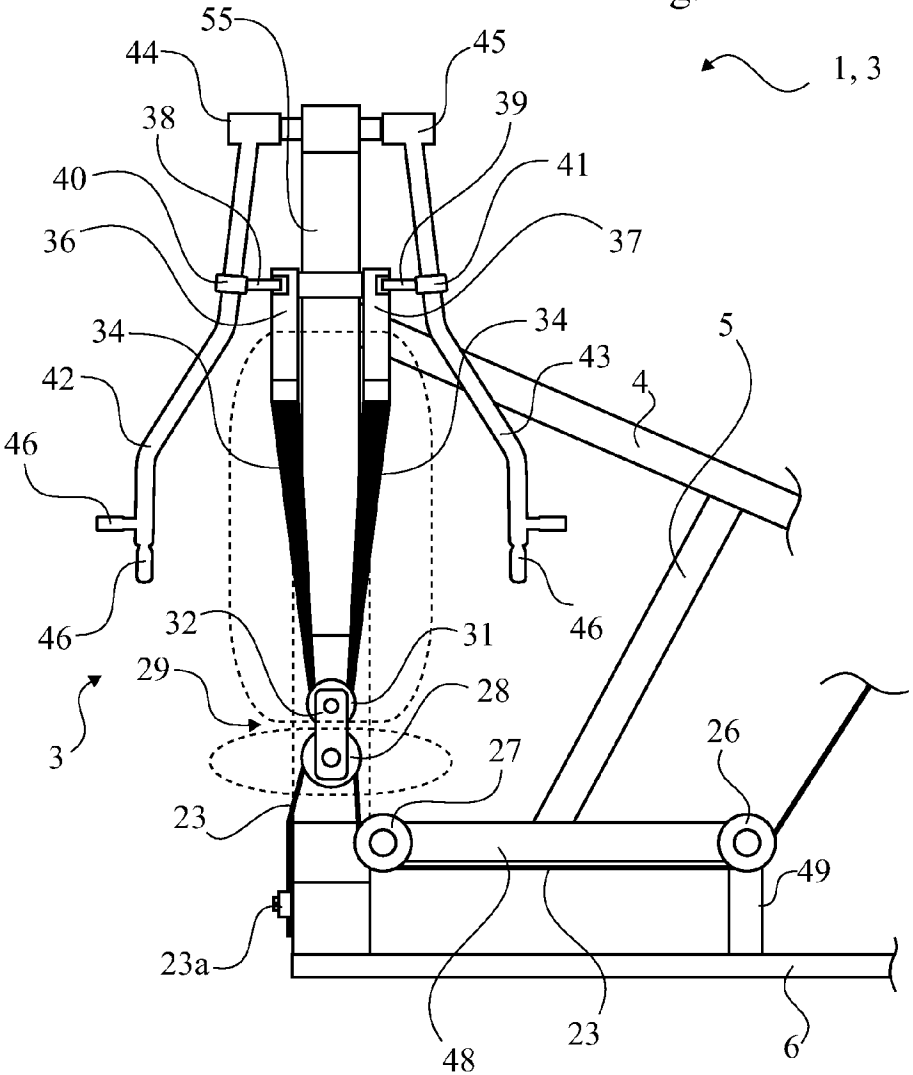
FIG. 2 shows partial front view of the training machine in FIG. 1 where a person who uses the machine has been deleted and where a seat with supporting frame is shown with broken lines for clarity.
Figure 4:
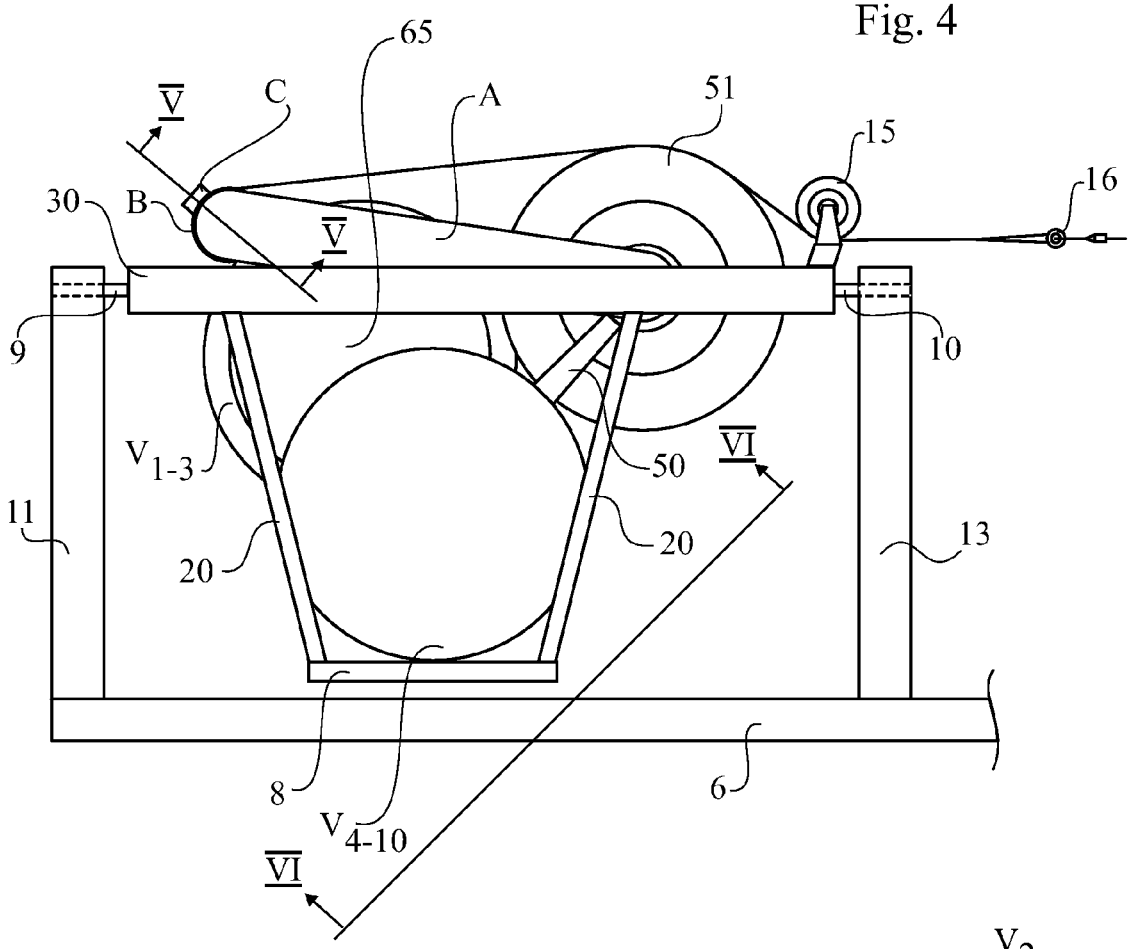
FIG. 4 shows a view from the opposite side of the weight portion of the training machine of FIG. 1.
Figure 5:
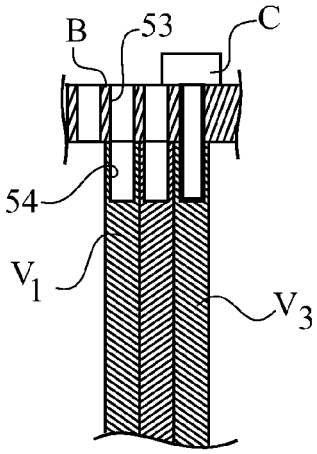
FIG. 5 shows a partial sectional view along the line V-V in FIG. 4 of a weight selection device.
Figure 6:
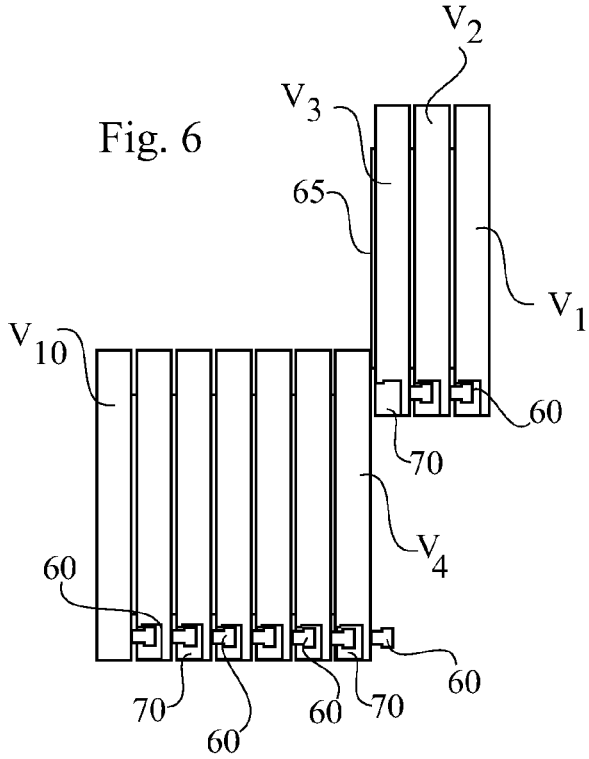
FIG. 6 shows a view along the line VI-VI in FIG. 4 of the weight discs of the weight package.
Figure 7:
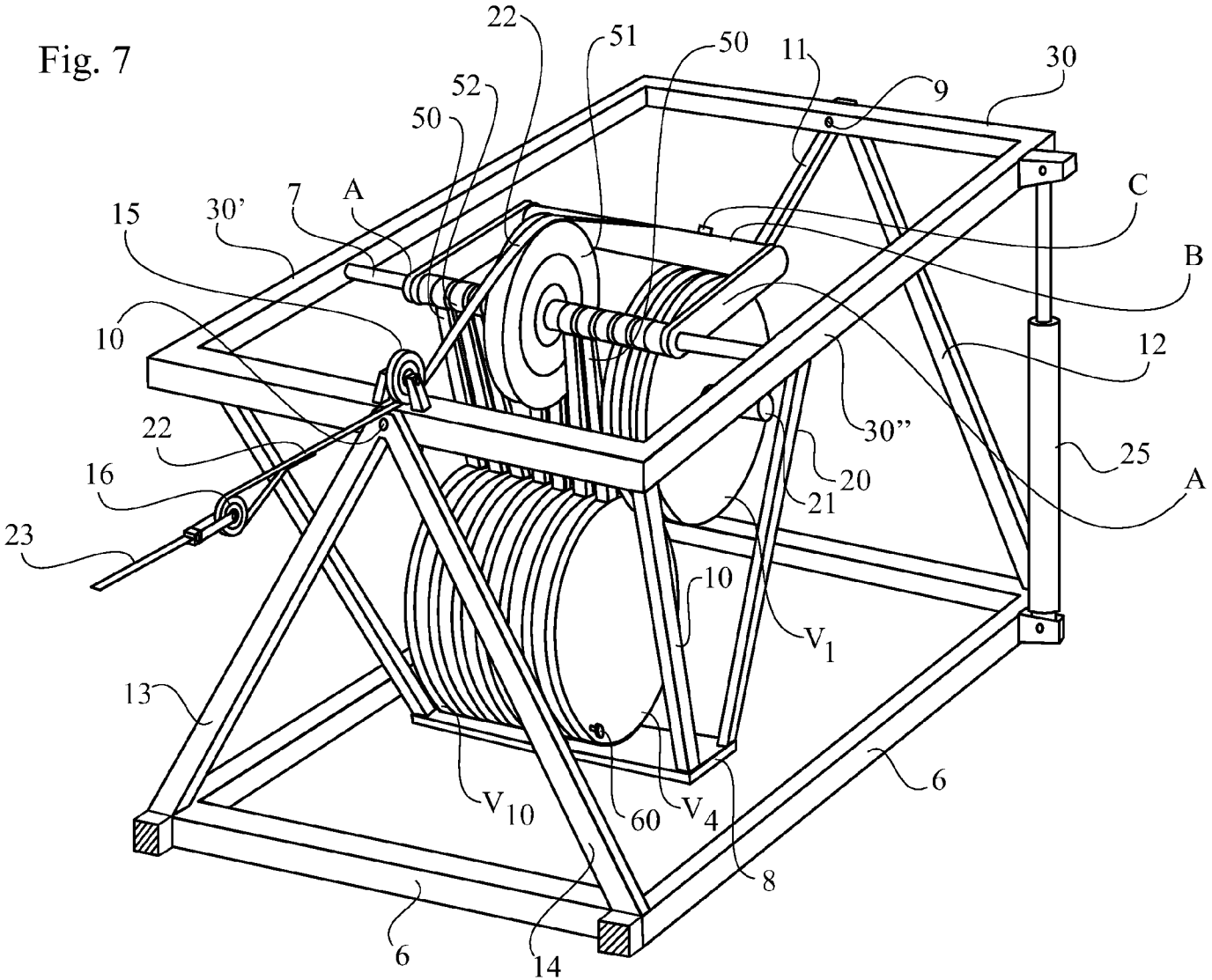
FIG. 7 shows a perspective view of the weight portion of FIG. 4.
Figure 10:
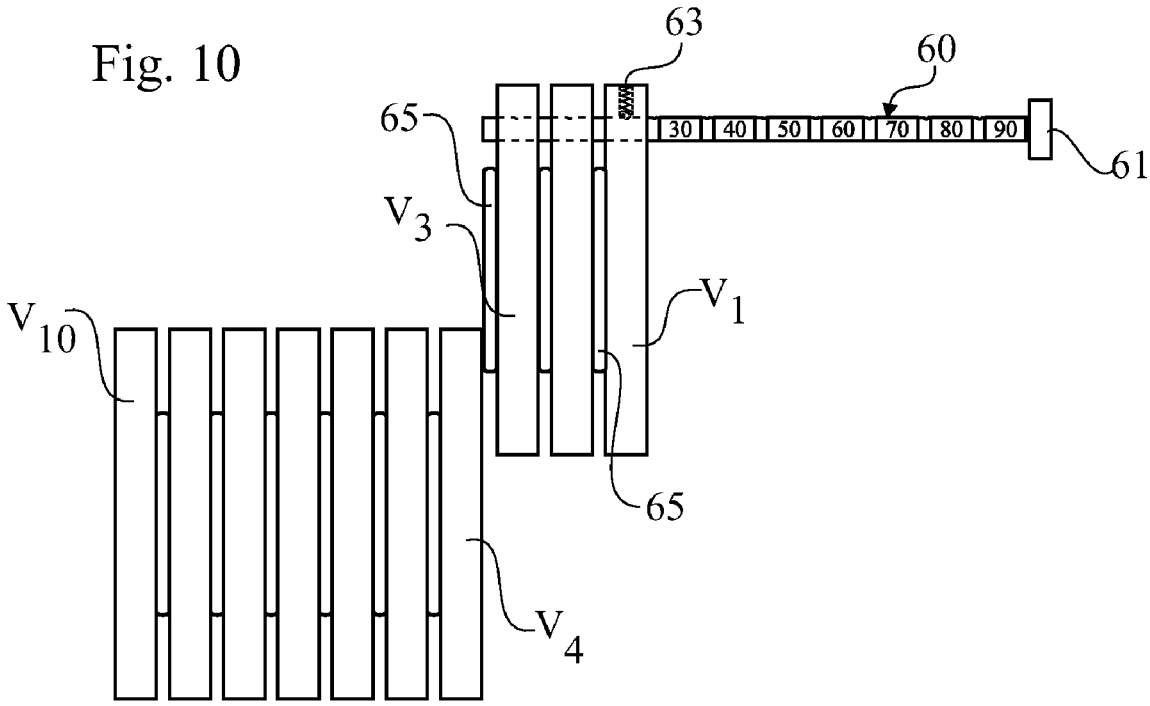
FIG. 10 shows a view along the line X-X in FIG. 9 of the weights of the weight package.
Figure 11:
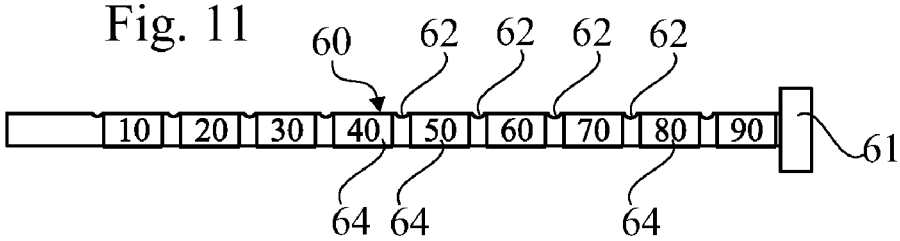
FIG. 11 shows a side view of a weight selecting setting stick for choosing weights used in the embodiment of FIG. 9-10.
Figure 12:
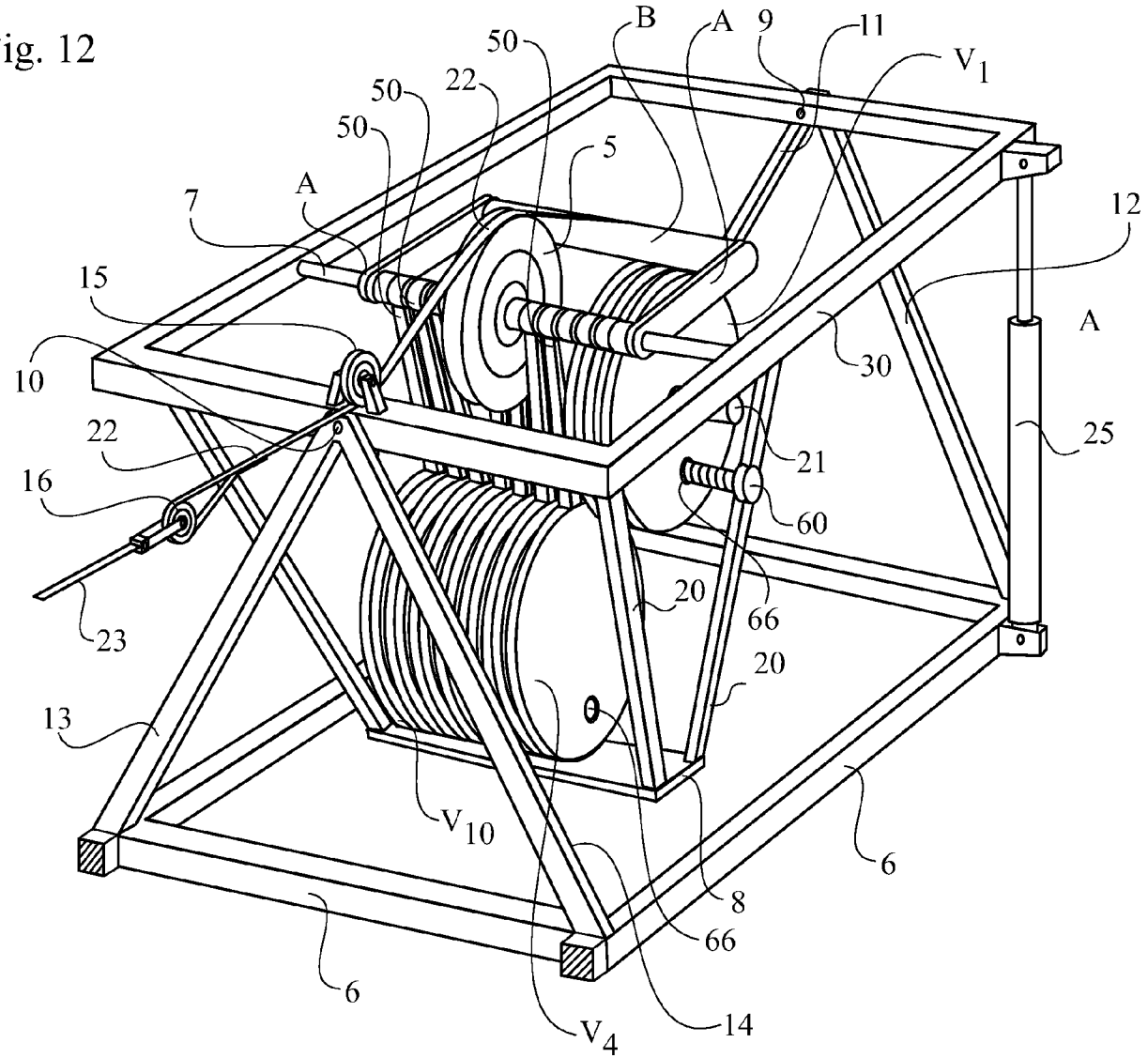
FIG. 12 shows a perspective view of the embodiment of the weight portion shown in FIG. 9-11.

A person who shall train using the strength training device 1 according to the invention sets on the chair 52 and then grips the handles 46 on the arms 42 and 43, as is evident from FIGS. 1 and 3. To facilitate the positive movement, i.e., the person presses the arms 42 and 43 outwardly from the body, the inner frame is then turned to a position according to FIG. 16 so that the power which is required to lift the upper weight package 1 is reduced by the inclination of the inner frame 30, whereas the weight package $V_{1-3}$ slides against the weight $V_4$ along a layer 65 of a low friction material, as plastics or nylon, which is provided on weights $V_{1-9}$ (see FIGS. 6 and 10). A reduction of the power which is required to press the handles forwards can be reduced with up to over 50%.

The positive power which is required to lift the weights will be substantially less than the negative force, i.e., in the order of more than 30%, more precisely about 40%. When the person begins the negative movement, i.e., the person moves the arms 42 and 43 inwardly towards the body to a stop/start position where the stop 47*a* abuts against the frame construction 55, the frame 30 is turned back to its original position (see FIG. 15) in which the person achieves full load from the selected weight package $V_{1-3}$. Turning the frame 30 by means of the cylinder device 25 occurs suitably automatically by means of a control unit (not shown) which via sensors senses the movement of the belts 22 and 23 and turns the frame 30 from the position in FIG. 15 to incline the weight package $V_{1-3}$ upwards and to the position shown in FIG. 16.

Figure 8:
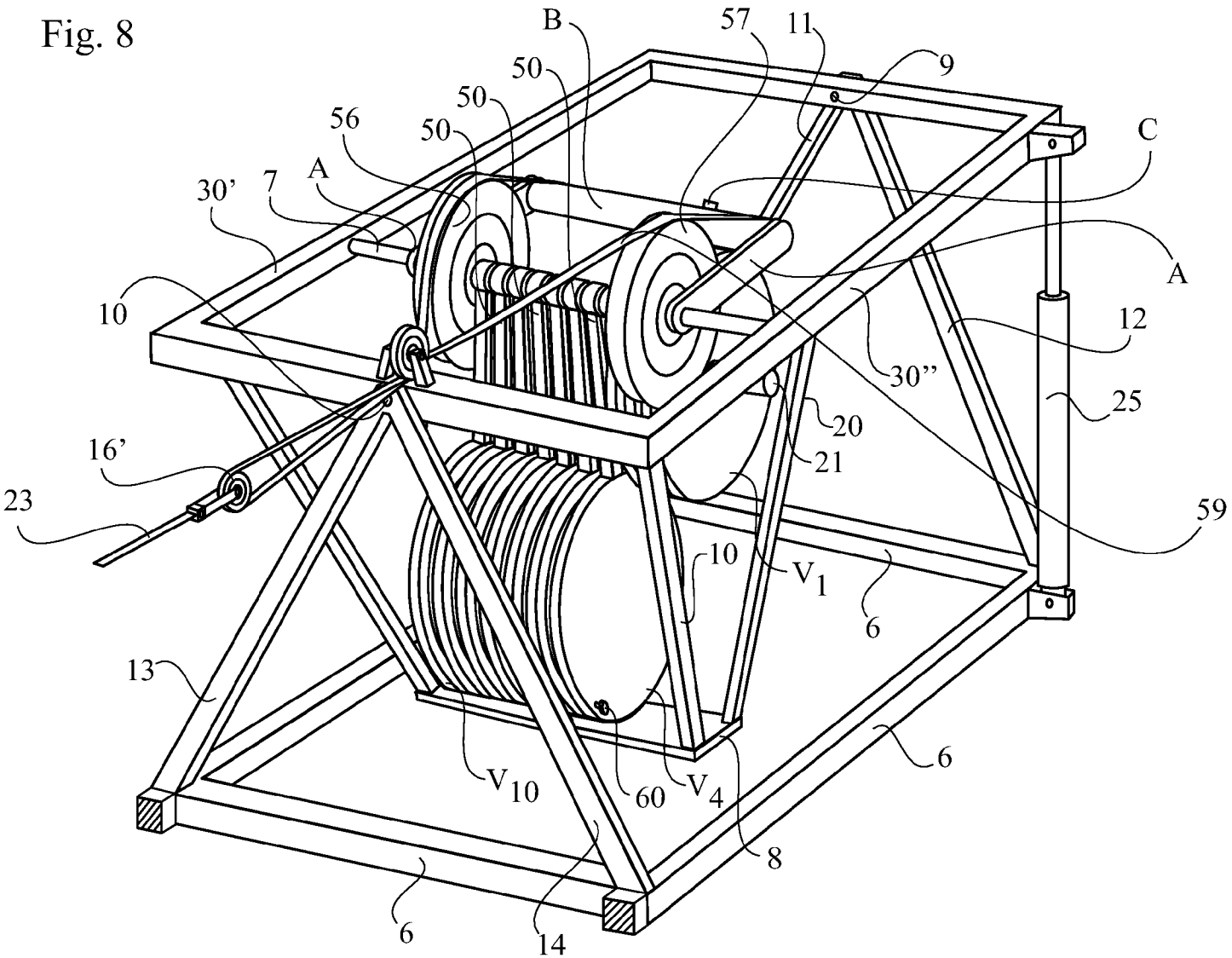
FIG. 8 shows a perspective view similar to that of FIG. 7 of another embodiment of the weight portion.
Figure 9:
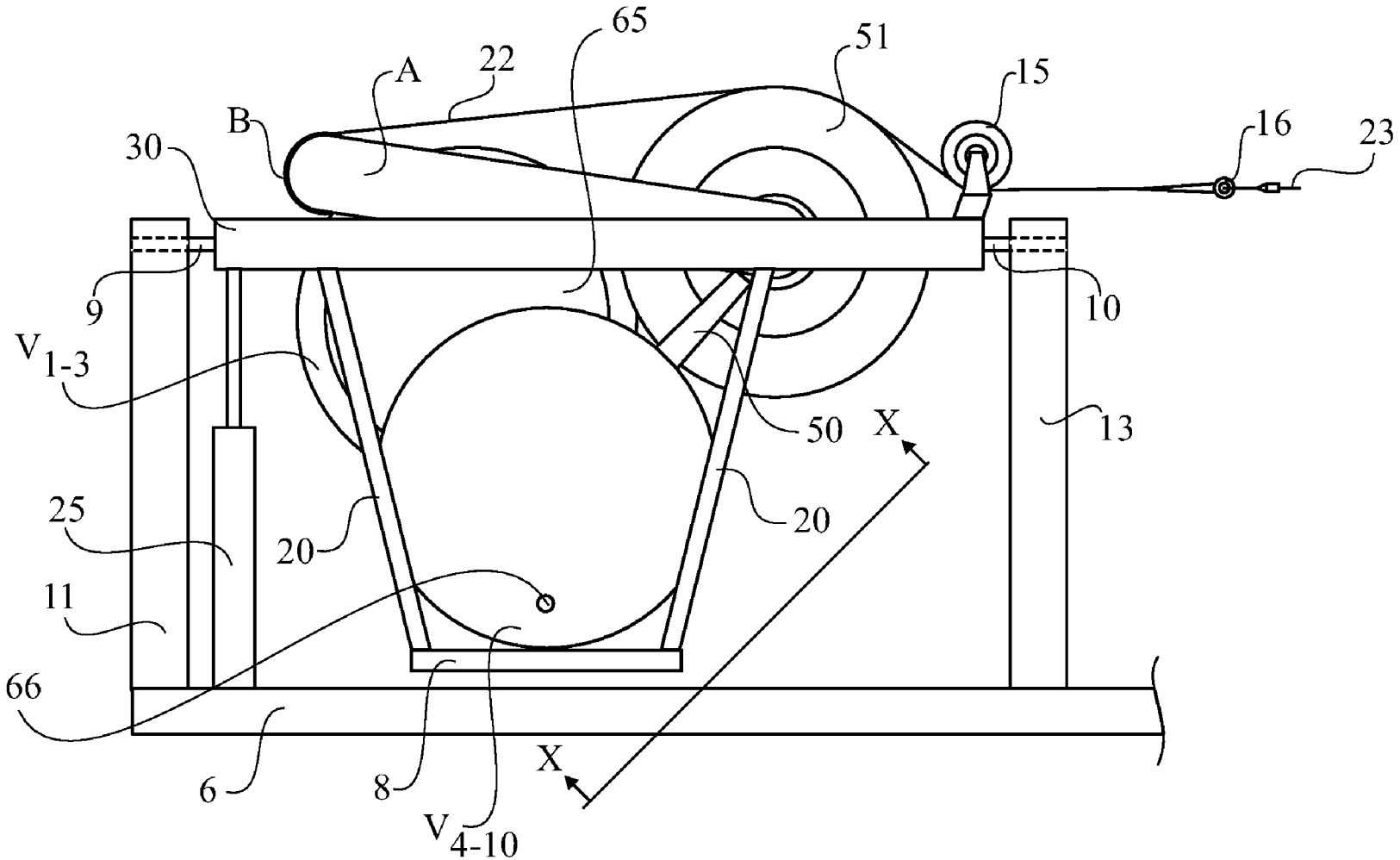
FIG. 9 shows a side view of yet another embodiment of the weight package portion of the training machine.

FIG. 8 shows another embodiment of the training machine 1 according to the invention which instead of one wheel 51 has two wheels 56 and 57 mounted for rotation on the shaft 7 with corresponding two belts 58, 59 attached to the U-formed member A/B. In this embodiment the wheel 16' takes up differences in belt tensions between the belt parts 58 and 59.

In FIGS. 9-12 a further embodiment of the training machine 1 according to the invention is shown. This embodiment differs in that the selection of weights is different. Instead of the pin member C a weight selection stick 60 is used. The stick 60 is provided with a knob 61 at its end and has recesses 62 to be engaged by a ball/spring clutch 63 to hold the stick in the chosen position. On the stick there are markings 64 displaying the weight of the selected weight package which in this case is shown as $V_{1-3}$ (see FIG. 10). Each weight $V_{1-10}$ has a through hole 66. The holes 66 are flush with each other when the weights $V_{1-10}$ are in the rest position on the rest plate 8. When weights $V_{1-10}$ are lifted by means of the belt 22, the selected weights $V_{1-3}$ slide on a disc 65 of low friction fixed to one side of the outermost weight $V_3$. Each weight $V_{1-9}$ has such a low friction disc 65 fixed to one side to facilitate lifting of the weight package when the frame 30 is inclined by means of the hydraulic cylinder device 25. The stick 60 is accordingly inserted into the holes 66 until the marking 64 closest to the disc shows the selected total weight of the selected weight package $V_{1-3}$, i.e., 30 kilo in the shown example.

Figure 13:
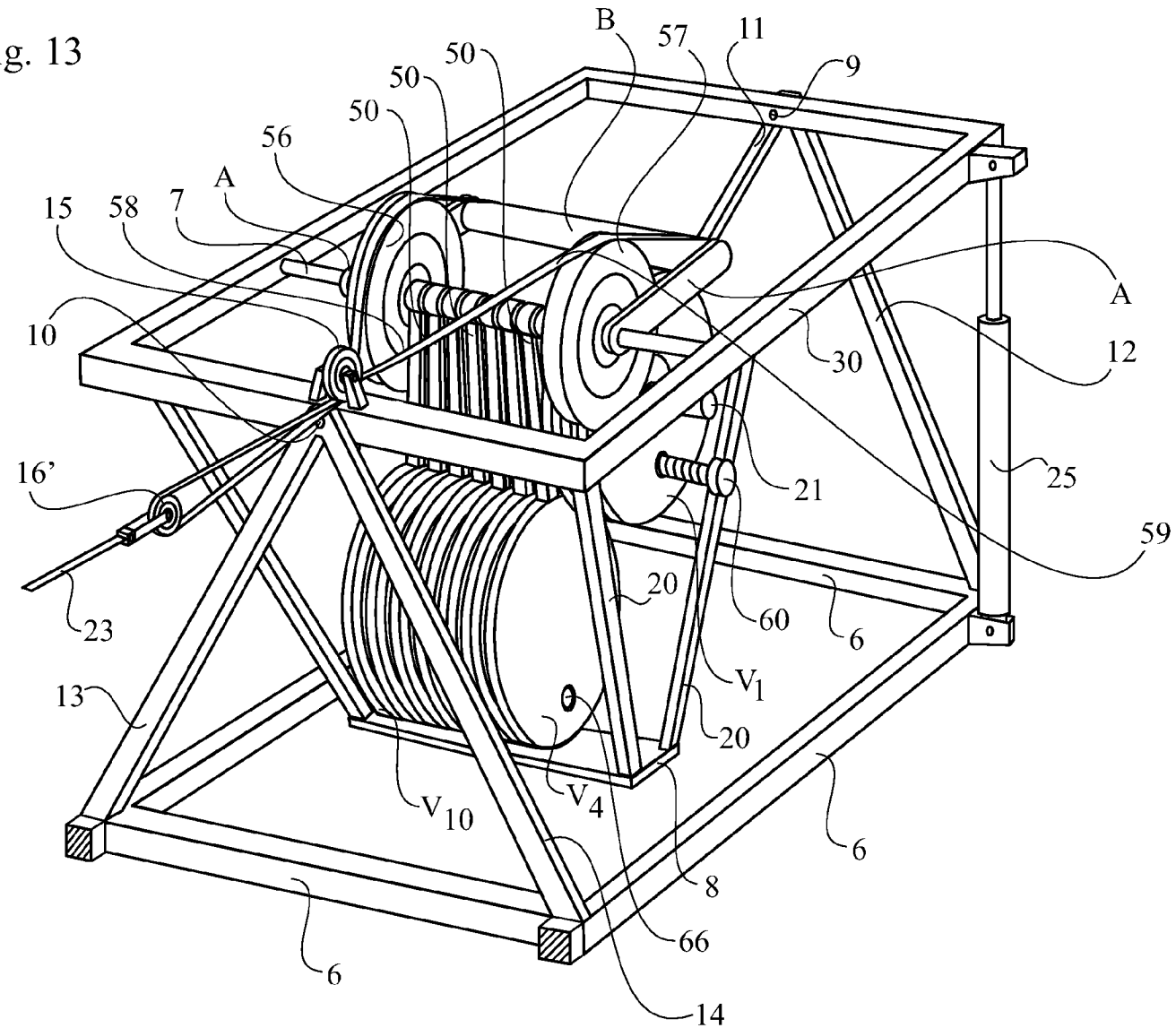
FIG. 13 shows a perspective view similar to that in FIG. 12 of another embodiment of the weight portion.

In FIG. 13 is shown another embodiment of the training machine 1 according to the invention which instead of one wheel 51 has two wheels 55 and 57 mounted for rotation on the shaft 7 with corresponding two belts attached to the U-formed member A/B. In this embodiment the wheel 16' takes up differences in belt tensions between the belt parts 58 and 59.

Figure 14:
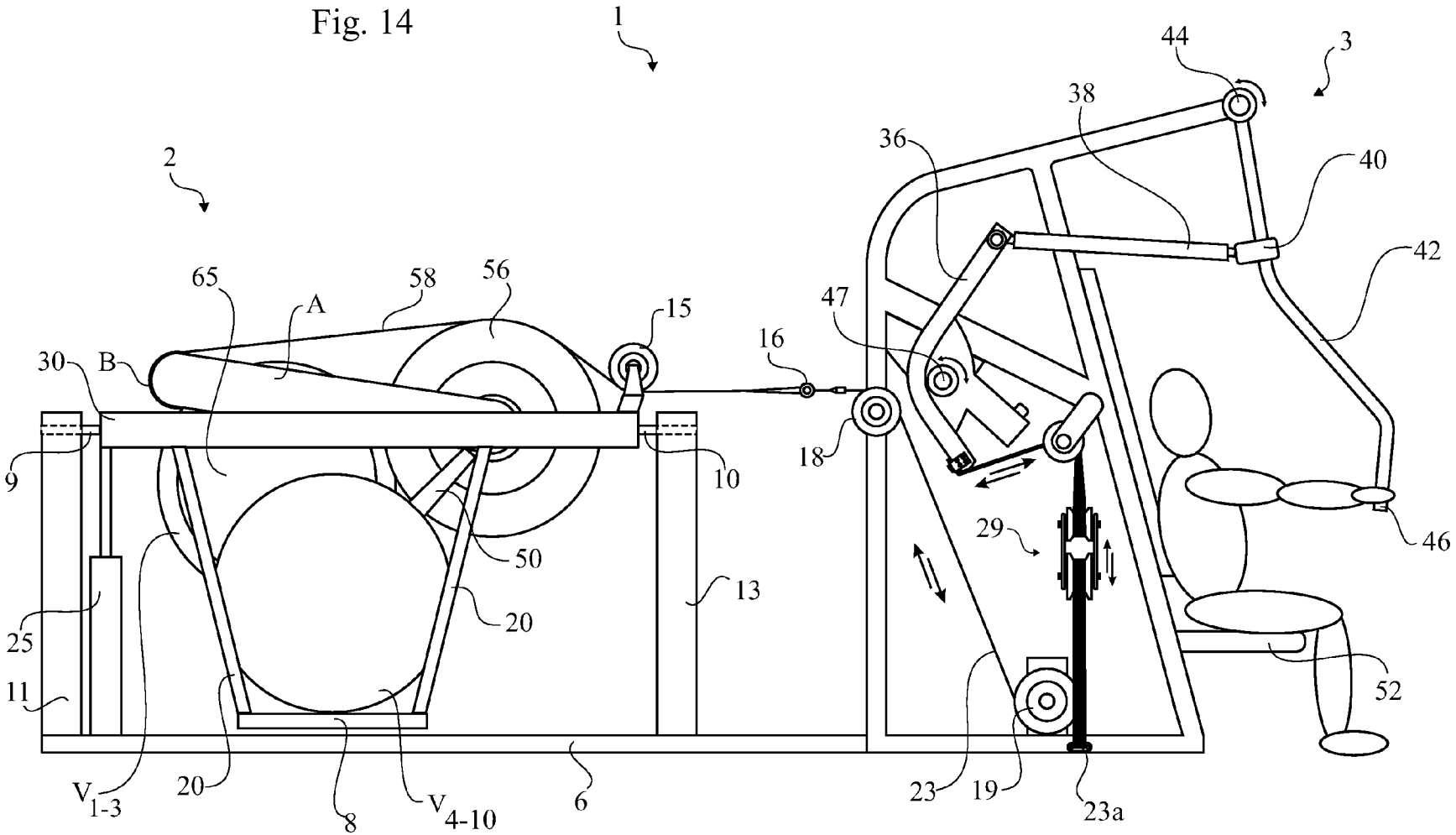
FIG. 14 shows yet another embodiment of the training machine for strength training and rehabilitation according to the invention in which the weight package is situated behind the user.
Figure 16:
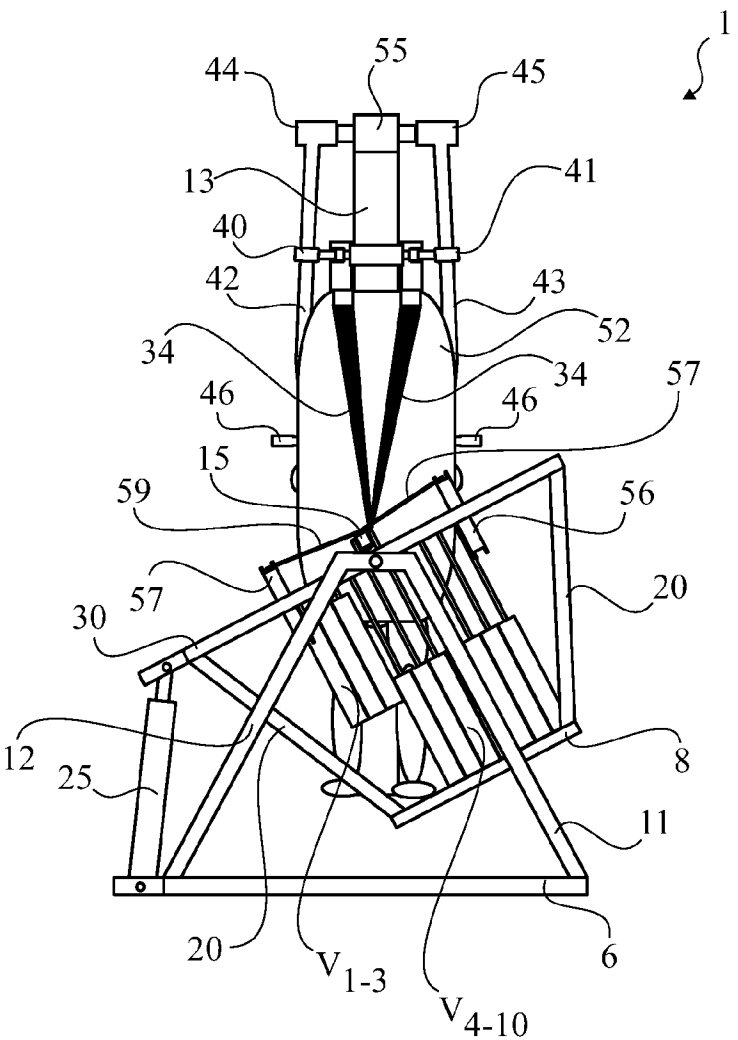
FIG. 16 shows a view from behind of the training machine of FIG. 14 in a position with the weights inclined.
Figure 15:
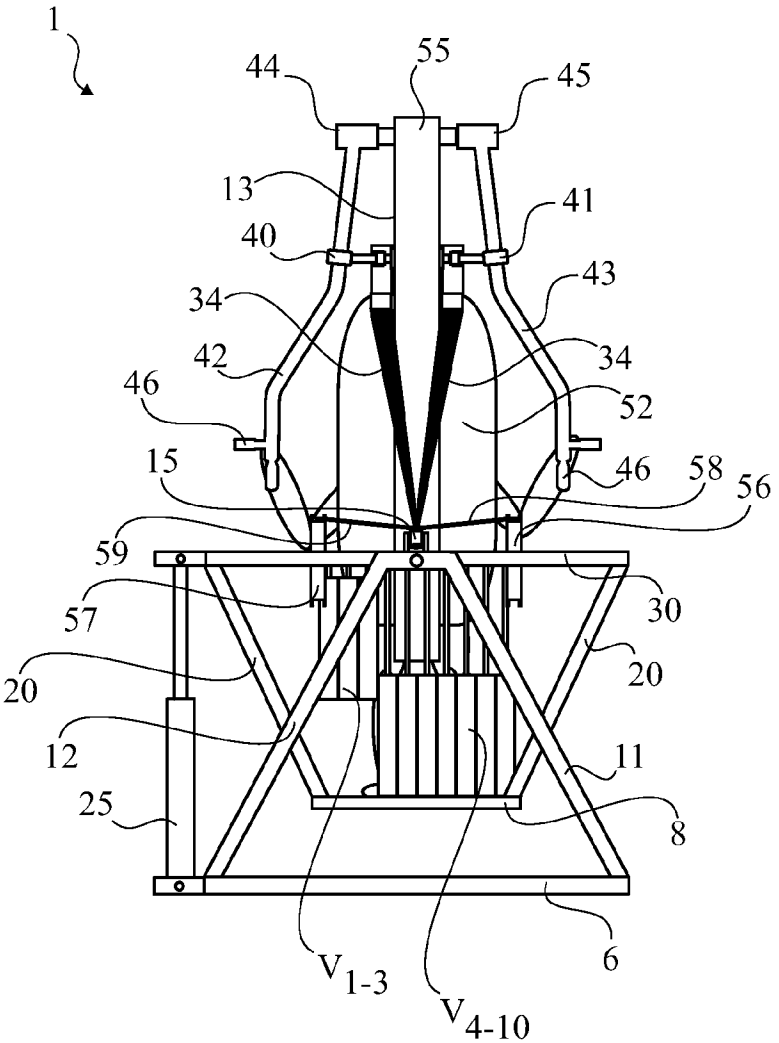
FIG. 15 shows a view from behind of the training machine of FIG. 14 in a position with the weights vertical.

FIG. 14-16 shows yet another embodiment of the training machine 1 according to the invention wherein the weight section 2 is mounted behind the training section 3 and the belt 22 is connected at 16 to the belt 23 which is lead over a pulley 18 and a further pulley 19 to the equalisation device on the training section 3.

FIGS. 15 and 16 show the tilting of the weight package frame 30 by means of the hydraulic cylinder device 25. In FIG. 15 it is shown the position of the frame 30 carrying the weights during the negative motion of the training person, and in FIG. 16 during the positive motion when the weights are inclined. In FIG. 16 the weight section is tilted about 45°, but this is only by way of example, and in fact the inclination depends on the desired reduction of weight.

At the shown and above described preferred embodiment of the training machine 1 according to the invention it is achieved that the trained person is given the possibility to either lift more weights than what is possible by means of conventional known machine or lift more times with the same weight as was earlier used.

In the embodiments a total number of ten weights are shown. It is evident that this number can be changed within the scope of the appended claims. The selection of weights is exemplified in the drawings wherein the weights are selected from one side. It should also be possible to select weights in another order and then provide each weight disc with a different weight. One such selection device could be the provision of a set of pins which are introduced in holes without having the catching protrusions. In another embodiment a predetermined number of protrusions are provided in which case the weights are divided in groups whereby each group has one pin for the selection of weights. In a development of the machine according to the invention the selection of weights in the weight package to be lifted could be achieved automatically by means of a weight selection device connected to the weight selection device. The pin could also be provided with a lock which by turning the pin would lock the weight to the lifting portion (in the former embodiments marked with B). The training section 3 of the training machine can be of any other known kind of exercise machine as a leg extension, an abdominal curl, a row exercise machine or a biceps curl The training machine 1 according to the invention can be modified within the scope of the appended claims wherein special features from the different embodiments could be combined.

The invention claimed is:

1. A training machine for strength training and rehabilitation comprising:

a machine frame;

a weight carrying frame;

a weight package carried by said weight carrying frame, pull or press means which are turnably provided on said machine frame and which are arranged to be moved backwards and forwards while a selected pre-determined number of weights in said weight package is arranged to be turned alternatively about a first axis by connection means connected to said pull or press means;

said weight carrying frame is turnable on said machine frame about a substantially horizontal second axis, and said first and second axes are substantially perpendicular to each other; and drive means for lifting a side of the weight carrying frame and said selected pre-determined number of weights in a continuous movement, whereby a user engages a first force applied against said pull or press means, and said drive means for lowering the side of the weight carrying frame and said selected pre-determined number of weights, whereby a user engages a second force applied against said pull or press means, said first force being less than said second force.

2. Training machine according to claim 1, wherein said second axis is substantially parallel to a lower, substantially horizontal side beam of the machine frame.

3. Training machine according to claim 1, wherein two pivot pins are journalled in bearings between the machine frame and the weight carrying frame and are provided along said second axis on both sides of said weight carrying frame.

4. Training machine according to claim 3, wherein said drive means is an hydraulic cylinder device motor, said driving means being arranged to move the selected pre-determined number of weights backwards and forwards between a pre-determined inclined position and a substantially vertical position, whereby the weight carrying frame is turned about said pivot pins.

5. Training machine according to claim 1, wherein said first force is substantially less than said second force, i.e., in the order of more than 30%, more precisely about 40%.

6. Training machine according to claim 1, wherein said connection means are constituted of at least one non-elastic wire or belt, preferably of the material Kevlar®, said at least one wire or belt being connected between said pull or press means and said selected pre-determined number of weights via a lever system and freely journalled pulleys arranged on the machine.

7. Training machine according to claim 6, wherein the material Kevlar® is led over a plurality of rolls, wherein a wheel takes up differences in belt tensions between the at least one wire or belt.

* * * * *